US008972270B2

(12) United States Patent
Oh et al.

(10) Patent No.: US 8,972,270 B2
(45) Date of Patent: Mar. 3, 2015

(54) METHOD AND AN APPARATUS FOR PROCESSING AN AUDIO SIGNAL

(75) Inventors: Hyen-O Oh, Seoul (KR); Chang Heon Lee, Seoul (KR); Jeongook Song, Seoul (KR); Yang Won Jung, Seoul (KR); Hong Goo Kang, Seoul (KR)

(73) Assignees: LG Electronics Inc., Seoul (KR); Industry-Academic Cooperation Foundation, Yonsei University, Seoul (KR)

( * ) Notice: Subject to any disclaimer, the term of this patent is extended or adjusted under 35 U.S.C. 154(b) by 1140 days.

(21) Appl. No.: 12/993,773

(22) PCT Filed: May 25, 2009

(86) PCT No.: PCT/KR2009/002745

§ 371 (c)(1),
(2), (4) Date: Nov. 19, 2010

(87) PCT Pub. No.: WO2009/142466

PCT Pub. Date: Nov. 26, 2009

(65) Prior Publication Data

US 2011/0075855 A1 Mar. 31, 2011

Related U.S. Application Data

(60) Provisional application No. 61/055,464, filed on May 23, 2008, provisional application No. 61/078,773, filed on Jul. 8, 2008, provisional application No. 61/085,005, filed on Jul. 31, 2008.

(30) Foreign Application Priority Data

May 21, 2009 (KR) ..... 10-2009-0044622

(51) Int. Cl.
*G10L 19/00* (2013.01)
*G10L 19/032* (2013.01)

(52) U.S. Cl.
CPC ..... *G10L 19/032* (2013.01)
USPC ..... 704/500; 704/501; 704/502; 704/200; 704/200.1

(58) Field of Classification Search
CPC ..... G10L 19/00; G10L 19/02; G10L 19/03; G10L 19/034; G10L 19/035; G10L 19/06
USPC ..... 704/500, 501, 502, 200.1, 200
See application file for complete search history.

(56) References Cited

U.S. PATENT DOCUMENTS 6,725,192 B1 4/2004 Araki
8,332,216 B2 * 12/2012 Kurniawati et al. ..... 704/229
2004/0162720 A1 * 8/2004 Jang et al. ..... 704/200.1

(Continued)

FOREIGN PATENT DOCUMENTS

WO WO 99/22365 A1 5/1999

*Primary Examiner* — Qi Han
(74) *Attorney, Agent, or Firm* — Birch, Stewart, Kolasch & Birch, LLP

(57) ABSTRACT

A method for processing an audio signal is disclosed. The method for processing an audio signal includes frequency-transforming an audio signal to generate a frequency-spectrum, deciding a weighting per band corresponding to energy per band using the frequency spectrum, receiving a masking threshold based on a psychoacoustic model, applying the weighting to the masking threshold to generate a modified masking threshold, and quantizing the audio signal using the modified masking threshold.

14 Claims, 12 Drawing Sheets

(56) References Cited

U.S. PATENT DOCUMENTS

2005/0043830 A1 2/2005 Lee et al.
2007/0208557 A1* 9/2007 Li et al. ..... 704/200.1
2007/0255562 A1* 11/2007 Kurniawati et al. ..... 704/230
2008/0130903 A1* 6/2008 Ojanpera ..... 381/2

* cited by examiner (A)

(B)

METHOD AND AN APPARATUS FOR PROCESSING AN AUDIO SIGNAL

This application is the National Phase of PCT/KR2009/002745 filed on May 25, 2009, which claims priority under 35 U.S.C. 119(e) to U.S. Provisional Application No(s). 61/055,464 filed on May 23, 2008, 61/078,773 filed on Jul. 8, 2008 and 61/085,005 filed on Jul. 31, 2008 and under 35 U.S.C. 119(a) to Patent Application No. 10-2009-0044622 filed in the Republic of Korea on May 21, 2009, all of which are hereby expressly incorporated by reference into the present application.

BACKGROUND OF THE INVENTION

1. Field of the Invention

The present invention relates to a method and an apparatus for processing an audio signal that encode or decode an audio signal.

2. Discussion of the Related Art

In general, auditory masking is explained by psychoacoustic theory. The masking effect uses properties of the psychoacoustic theory in that low volume signals adjacent to high volume signals are overwhelmed by the high volume signals, thereby preventing a listener from hearing the low volume signals. During quantization of an audio signal, a quantization error occurs. Such quantization error may be appropriately allocated using a masking threshold, with the result that quantization noise may not be heard.

However, bits are insufficient for a low bit rate codec, with the result that it is not possible to completely mask such quantization noise. In this case, perceived distortion cannot be avoided, and therefore, it is necessary to allocate bits so as to minimize the perceived distortion.

According to the properties of the human auditory system, on the other hand, a speech signal is more sensitive to quantization noise of a frequency band having relatively low energy than to quantization noise of a frequency band having relatively high energy.

In particular, a psychoacoustic model based on a signal excitation pattern is applied to a signal containing a mixture of speech and music, and therefore, quantization noise is allocated irrespective of the human auditory property. As a result, it is not possible to effectively allocate a quantization error, thereby increasing perceived distortion.

SUMMARY OF THE INVENTION

Accordingly, the present invention is directed to a method for processing an audio signal and apparatus that substantially obviate one or more problems due to limitations and disadvantages of the related art.

An object of the present invention is to provide a method for processing an audio signal and apparatus that are capable of adjusting a masking threshold based on a relationship between the magnitude of energy and sensitivity of quantization noise, thereby efficiently quantizing an audio signal.

Another object of the present invention is to provide a method for processing an audio signal and apparatus that are capable of applying an auditory property for a speech signal with respect to an audio signal having a speech component and a non-speech component in a mixed state, thereby improving sound quality of the speech signal.

A further object of the present invention is to provide a method for processing an audio signal and apparatus that are capable of adjusting a masking threshold without use of additional bits under the same bit rate condition, thereby improving sound quality.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for processing an audio signal includes frequency-transforming an audio signal to generate a frequency spectrum, deciding a weighting per band corresponding energy per band using the frequency spectrum, receiving a masking threshold based on a psychoacoustic model, applying the weighting to the masking threshold to generate a modified masking threshold, and quantizing the audio signal using the modified masking threshold.

The weighting per band may be generated based on a ratio of energy of a current band to average energy of a whole band.

The method for processing an audio signal may further include calculating loudness based on constraints of a given bit rate using the frequency spectrum, and the modified masking threshold may be generated based on the loudness.

The method for processing an audio signal may further include deciding a speech property with respect to the audio signal, and the step of deciding the weighting per band and the step of generating the modified masking threshold may be carried out in a band having the speech property of a whole band of the audio signal.

In another aspect of the present invention, a method for processing an audio signal includes frequency-transforming an audio signal to generate a frequency spectrum, deciding a weighting including a first weighting corresponding to a first band and a second weighting corresponding to a second band based on the frequency spectrum, receiving a masking threshold based on a psychoacoustic model, applying the weighting to the masking threshold to generate a modified masking threshold, and quantizing the audio signal using the modified masking threshold, wherein the audio signal is stronger in the first band than on average and is weaker in the second band than on average.

The first weighting may have a value of 1 or more, and the second weighting may have a value of 1 or less.

The modified masking threshold may be generated based on loudness per band, and the weighting per band may be applied to the loudness per band.

In another aspect of the present invention, an apparatus for processing an audio signal includes a frequency-transforming unit for frequency-transforming an audio signal to generate a frequency spectrum, a weighting decision unit for deciding a weighting per band corresponding energy per band using the frequency spectrum, a masking threshold generation unit for receiving a masking threshold based on a psychoacoustic model and applying the weighting to the masking threshold to generate a modified masking threshold, and a quantization unit for quantizing the audio signal using the modified masking threshold.

The weighting per band may be generated based on a ratio of energy of a current band to average energy of a whole band.

The masking threshold generation unit may calculate loudness based on constraints of a given bit rate using the frequency spectrum, and the modified masking threshold may be generated based on the loudness.

In another aspect of the present invention, an apparatus for processing an audio signal includes a frequency-transforming unit for frequency-transforming an audio signal to generate a frequency spectrum, a weighting decision unit for deciding a weighting including a first weighting corresponding to a first band and a second weighting corresponding to a second band based on the frequency spectrum, a masking threshold generation unit for receiving a masking threshold based on a psychoacoustic model and applying the weighting to the masking threshold to generate a modified masking threshold, and a quantization unit for quantizing the audio signal using the modified masking threshold, wherein the audio signal is stronger in the first band than on average and is weaker in the second band than on average.

The first weighting may have a value of 1 or more, and the second weighting may have a value of 1 or less.

The modified masking threshold may be generated based on loudness per band, and the weighting per band may be applied to the loudness per band.

In another aspect of the present invention, a method for processing an audio signal includes receiving spectral data and a scale factor with respect to an audio signal and restoring the audio signal using the spectral data and the scale factor, wherein the spectral data and the scale factor are generated by applying a modified masking threshold to the audio signal, and the modified masking threshold is generated by applying a weighting per band corresponding to energy per band to a masking threshold based on a psychoacoustic model.

In a further aspect of the present invention, there is provided a storage medium for storing digital audio data, the storage medium being configured to be read by a computer, wherein the digital audio data include spectral data and a scale factor, the spectral data and the scale factor are generated by applying a modified masking threshold to an audio signal, and the modified masking threshold is generated by applying a weighting per band corresponding to energy per band to a masking threshold based on a psychoacoustic model.

The present invention has the following effects and advantages.

First, it is possible to adjust a masking threshold based on a relationship between the magnitude of energy and sensitivity of quantization noise, thereby minimizing perceived distortion even under a low bit rate condition.

Second, it is possible to apply the principles of human hearing to a speech signal while maintaining sound quality of a music signal. In addition, it is possible to improve sound quality of the speech signal without an increase in a bit rate.

Third, it is possible to effectively improve sound quality of a signal having a spectral tilt or formant, such as a speech vowel without changing the bit rate.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Figure 1:
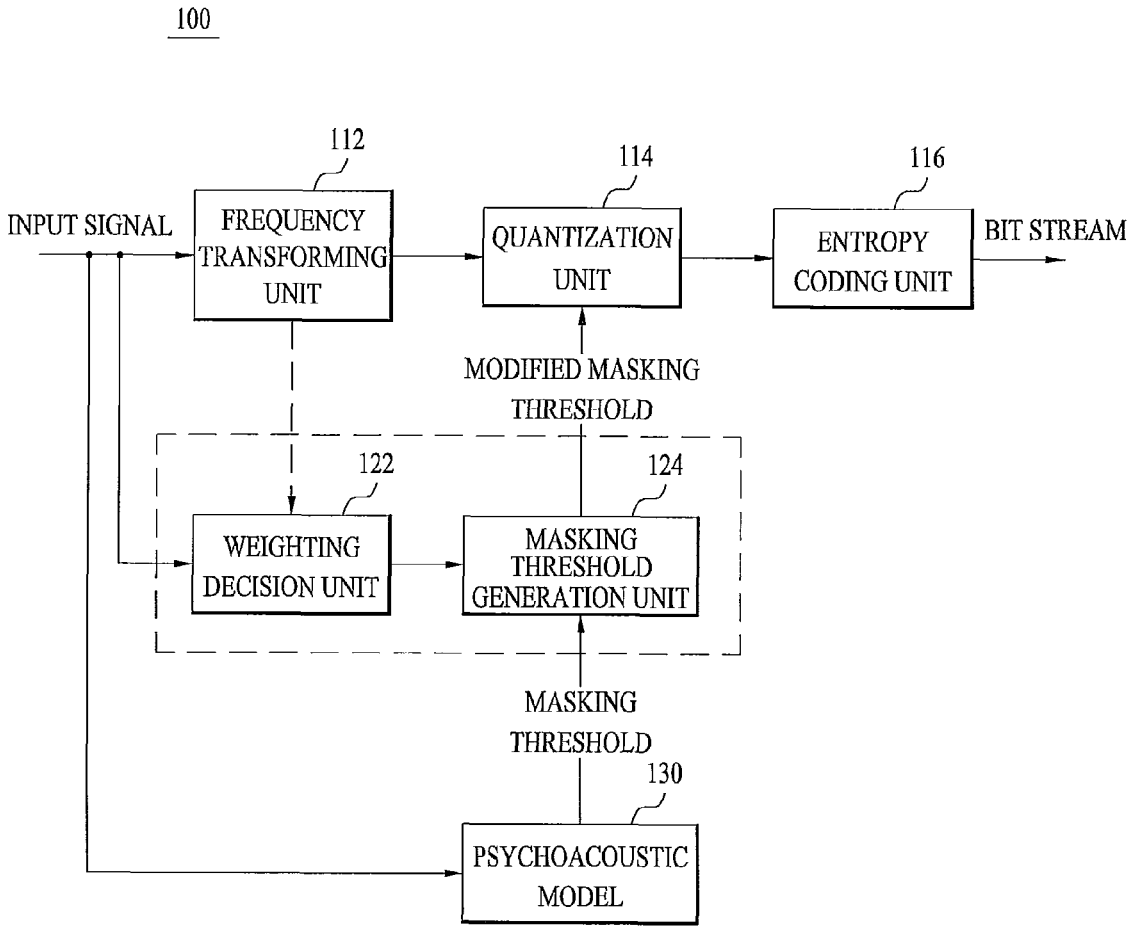
FIG. 1 is a construction view illustrating a spectral data encoding device of an apparatus for processing an audio signal according to an embodiment of the present invention.

Reference will now be made in detail to the preferred embodiments of the present invention, examples of which are illustrated in the accompanying drawings. First of all, terminology used in this specification and claims must not be construed as limited to the general or dictionary meanings thereof and should be interpreted as having meanings and concepts matching the technical idea of the present invention based on the principle that an inventor is able to appropriately define the concepts of the terminologies to describe the invention in the best way possible. The embodiment disclosed herein and configurations shown in the accompanying drawings are only one preferred embodiment and do not represent the full technical scope of the present invention. Therefore, it is to be understood that the present invention covers the modifications and variations of this invention provided they come within the scope of the appended claims and their equivalents when this application was filed.

According to the present invention, terminology used in this specification can be construed as the following meanings and concepts matching the technical idea of the present invention. Specifically, 'coding' can be construed as 'encoding' or 'decoding' selectively and 'information' as used herein includes values, parameters, coefficients, elements and the like, and meaning thereof can be construed as different occasionally, by which the present invention is not limited.

In this disclosure, in a broad sense, an audio signal is conceptionally discriminated from a video signal and designates all kinds of signals that can be perceived by a human. In a narrow sense, the audio signal means a signal having none or small quantity of speech characteristics. "Audio signal" as used herein should be construed in a broad sense. Yet, the audio signal of the present invention can be understood as an audio signal in a narrow sense in case of being used as discriminated from a speech signal.

Meanwhile, a frame indicates a unit used to encode or decode an audio signal, and is not limited in terms of sampling rate or time.

A method for processing an audio signal according to the present invention may be a spectral data encoding/decoding method, and an apparatus for processing an audio signal according to the present invention may be a spectral data encoding/decoding apparatus. In addition, the method for processing an audio signal according to the present invention may be an audio signal encoding/decoding method to which the spectral data encoding/decoding method is applied, and the apparatus for processing an audio signal according to the present invention may be an audio signal encoding/decoding apparatus to which the spectral data encoding/decoding apparatus is applied. Hereinafter, a spectral data encoding/decoding apparatus will be described, and a spectral data encoding/decoding method performed by the spectral data encoding/decoding apparatus will be described. Subsequently, an audio signal encoding/decoding apparatus and method, to which the spectral data encoding/decoding apparatus and method are applied, will be described.

Figure 2:
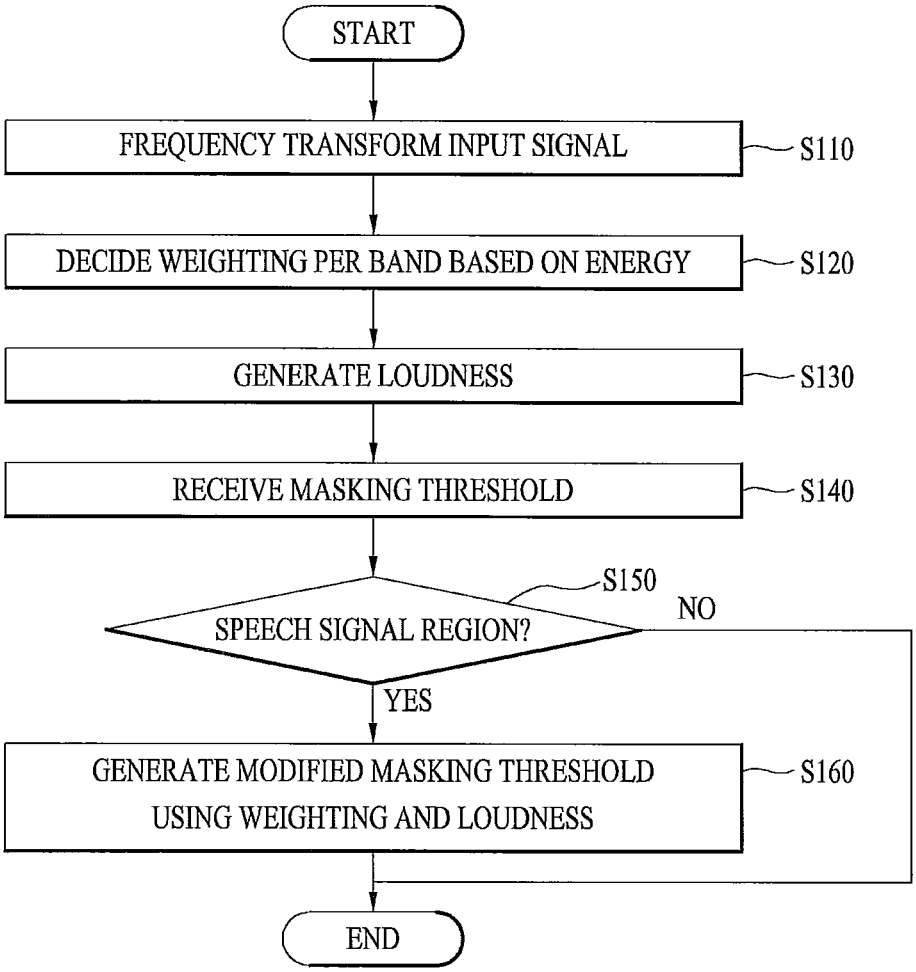
FIG. 2 is a flow chart illustrating a method for processing an audio signal according to an embodiment of the present invention.

FIG. 1 is a construction view illustrating a spectral data encoding device of an apparatus for processing an audio signal according to an embodiment of the present invention, and FIG. 2 is a flow chart illustrating a method for processing an audio signal according to an embodiment of the present invention. An audio signal processing process of a spectral data encoding device, specifically a process of quantizing an audio signal based on a psychoacoustic model, will be described in detail with reference to FIGS. 1 and 2.

Referring first to FIG. 1, a spectral data encoding device 100 includes a weighting decision unit 122 and a masking threshold generation unit 124. The spectral data encoding device 100 may further include a frequency-transforming unit 112, a quantization unit 114, an entropy coding unit 116, and a psychoacoustic model 130.

Referring to FIGS. 1 and 2, the frequency-transforming unit 112 perform time to frequency-transforming (or simply frequency-transforming) with respect to an input audio signal to generate a frequency spectrum (S110). A spectral coefficient may be generated through the time to frequency-transforming. Here, the time to frequency-transforming may be performed based on quadrature mirror filterbank (QMF) or modified discrete Fourier transform (MDCT), by which, however, the present invention is not limited. The spectral coefficient may be an MDCT coefficient acquired through MDCT.

The weighting decision unit 122 decides a weighting per band, specifically energy per band, based on the frequency spectrum (S120). Here, the frequency spectrum may be generated by the frequency-transforming unit 112 at Step S110, or the frequency spectrum may be generated from the input audio signal by the weighting decision unit 122. Here, the weighting per band is provided to modify a masking threshold. The weighting per band is a value corresponding to energy per band. The weighting per band may be proportional to the energy per band. When the energy per band is higher than average (or is relatively high), the weighting per band may have a value of 1 or more. When the energy per band is lower than the average (or is relatively low), the weighting per band may have a value of 1 or less. The weighting per band will be described in detail with reference to FIGS. 3 and 4.

The psychoacoustic model 130 applies a masking effect to the input audio signal to generate a masking threshold. The masking effect is based on psychoacoustic theory. Auditory masking is explained by psychoacoustic theory. The masking effect uses properties of the psychoacoustic theory in that low volume signals adjacent to high volume signals are overwhelmed by the high volume signals, thereby preventing a listener from hearing the low volume signals. For example, the highest gains may be seen around the middle of the auditory spectrum, and several bands having much lower gains may be present around the peak band. Here, the highest volume signal serves as a masker, and a masking curve is drawn based on the masker. The low volume signals covered by the masking curve serve as masked signals or maskees. Leaving the remaining signals as effective signals excluding the masked signals is masking. The masking threshold is generated based on the psychoacoustic model, which is an empirical model, using the masking effect.

The masking threshold generation unit 124 generates loudness through application of the weighting per band (S130) and receives the masking threshold from the psychoacoustic model 130 (S140). Subsequently, speech properties of the audio signal are analyzed. When the current band corresponds to an audio signal region ("YES" at Step S150), the weighting generated at Step S130 is applied to the masking threshold to generate a modified masking threshold (S160). At Step S160, the loudness may be further used, which will be described in detail with reference to FIGS. 3 and 4. However, Step S160 may be performed irrespective of the speech properties, i.e., irrespective of a condition at Step S150. Upon determination of the speech properties, it may be determined whether speech is a voiced sound or a voiceless sound. The determination as to whether speech is a voiced sound or a voiceless sound may be performed based on linear prediction coding (LPC), to which, however, the present invention is not limited.

The quantization unit 114 quantizes a spectral coefficient based on the modified masking threshold to generate spectral data and a scale factor.

$$X \cong 2^{\frac{scalefactor}{4}} \times \text{spectral_data}^{\frac{4}{3}} \qquad \text{[Mathematical expression 1]}$$

Where, X indicates a spectral coefficient, scalefactor indicates a scale factor, and spectral_data indicates spectral data.

Mathematical expression 1 is not an equality. Since both the scale factor and the spectral data are integers, it is not possible to express all arbitrary X due to resolution of these values. For this reason, Mathematical expression 1 is not an equality. Consequently, the right side of Mathematical expression 1 may be expressed X' as represented by Mathematical expression 2 below.

$$X' = 2^{\frac{scalefactor}{4}} \times \text{spectral_data}^{\frac{4}{3}} \qquad \text{[Mathematical expression 2]}$$

An error may occur during quantization of the spectral coefficient. An error signal may indicate the difference between the original coefficient X and the quantized value X' as represented by Mathematical expression 3 below.

$$\text{Error}=X-X' \qquad \text{[Mathematical expression 3]}$$

Where, X is the same as in Mathematical expression 1, and X' is the same as in Mathematical expression 2.

Energy corresponding to the error signal Error is a quantization error $E_{error}$.

A scale factor and spectral data are obtained using the masking threshold $E_{th}$ and the quantization error $E_{error}$ acquired as described above to satisfy a condition expressed in Mathematical expression 4 below.

$$E_{th}>E_{error} \quad \text{[Mathematical expression 4]}$$

Where, $E_{th}$ indicates a masking threshold, and $E_{error}$ indicates a quantization error.

That is, since the quantization error is less than the masking threshold when the above condition is satisfied, noise due to quantization is covered by the masking effect. In other words, listeners cannot perceive the quantized noise.

The entropy encoding unit 116 entropy codes the spectral data and the scale factor. The entropy coding may be performed based on a Huffman coding scheme, to which, however, the present invention is not limited. Subsequently, the entropy coded result is multiplexed to generate a bit stream.

Hereinafter, a first example of the weighting decision step (S120), the loudness generation step (S130), and the weighting application step (S160) of the method for processing an audio signal according to the embodiment of the present invention will be described with reference to FIG. 3, and a second example of the weighting decision step (S120), the loudness generation step (S130), and the weighting application step (S160) of the method for processing an audio signal according to the embodiment of the present invention will be described with reference to FIG. 4. In the first example, two weightings, each of which is a constant, are used. In the second example, energy and a band-specific weighting are used.

Figure 3:
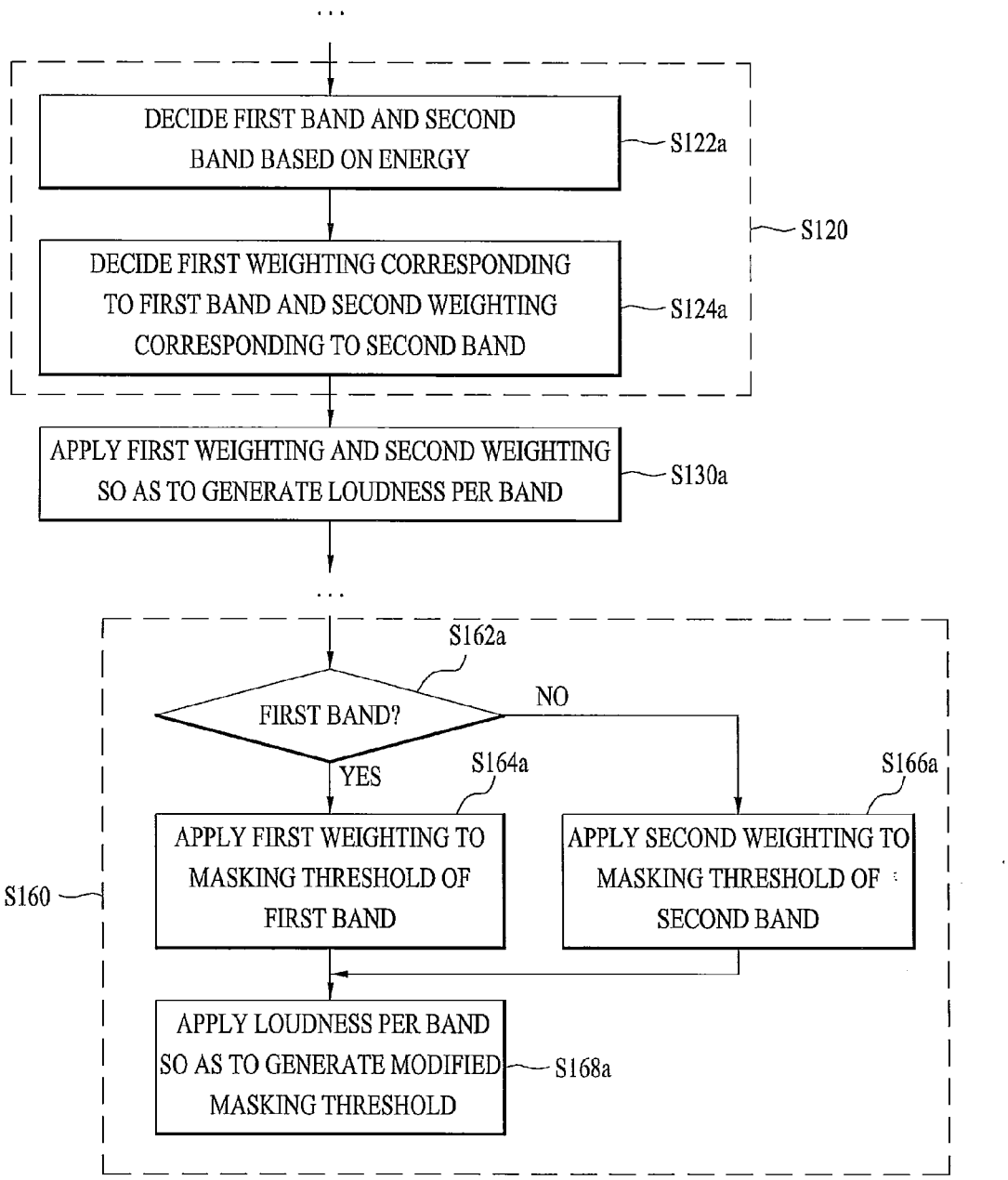
FIG. 3 is a view illustrating a first example of a weighting value decision step and a weighting value application step of the method for processing an audio signal according to the embodiment of the present invention.
Figure 4:
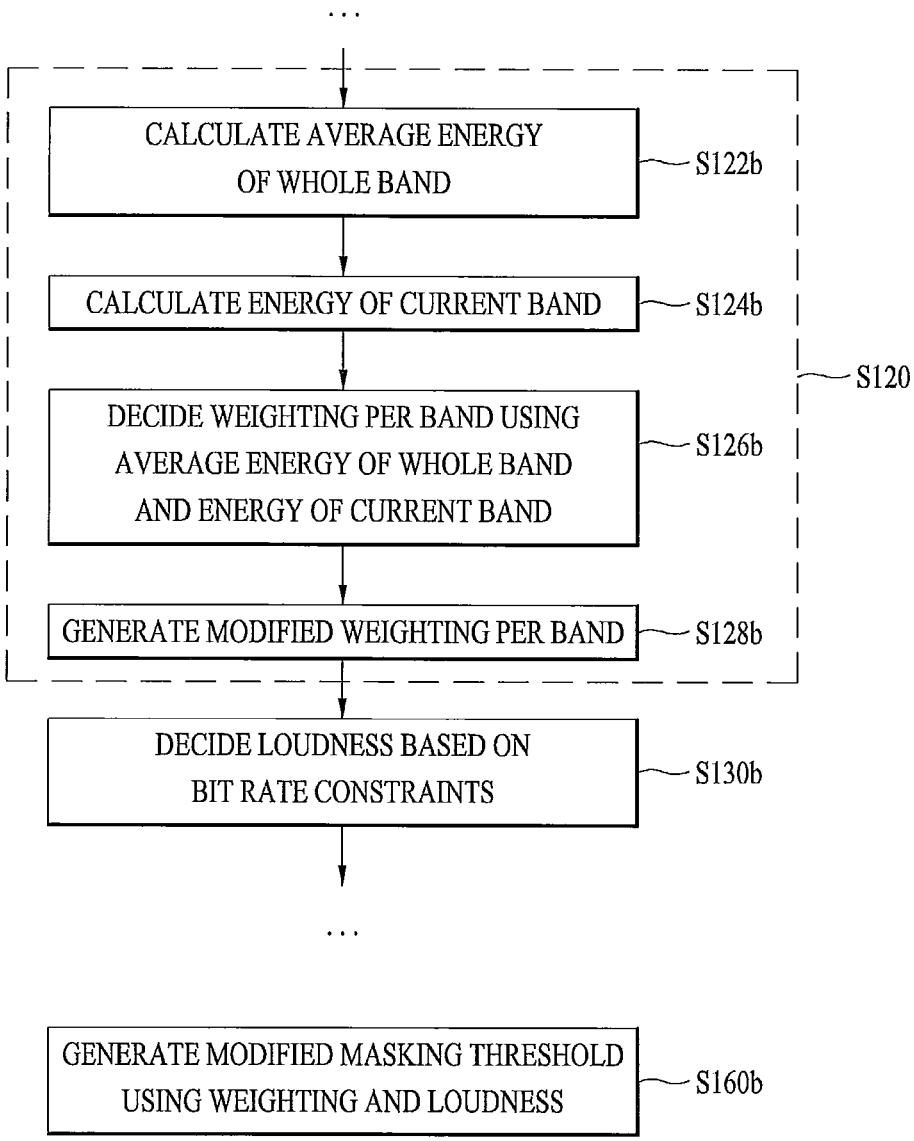
FIG. 4 is a view illustrating a second example of a weighting decision step and a weighting application step of the method for processing an audio signal according to the embodiment of the present invention.

Referring to FIG. 3, sub steps of the weighting decision step (S120) and sub steps of the weighting application step (S160) are shown.

A whole band is divided into a first band and a second band based on a frequency spectrum and energy (S122*a*). For example, the first band has higher energy than average energy of the whole band, and the second band has lower energy than average energy of the whole band. The first band may be a frequency band decided based on harmonic frequency. For example, a frequency corresponding to the harmonic frequency may be defined as represented by the following mathematical expression.

$$F_0=[f_1, \ldots f_M] \quad \text{[Mathematical expression 6]}$$

The first band N having high energy may be defined as represented by the following mathematical expression based on the harmonic frequency.

$$N=[n_1, \ldots, n_{M'}] \quad \text{[Mathematical expression 7]}$$

The remaining band, excluding the first band N, is the second band.

Subsequently, a first weighting corresponding to the first band and a second weighting corresponding to the second band are decided (S124*a*). For example, the first weighting and the second weighting may be decided as represented by the following mathematical expression.

$$a \text{ for } n_i \in N$$

$$b \text{ for } n_i \notin N \quad \text{[Mathematical expression 8]}$$

Where, a indicates a first weighting, and b indicates a second weighting.

The first weighting may have a value of 1 or more, and the second weighting may have a value of 1 or less. Specifically, the first weighting is a weighting with respect to a band having higher energy than average energy. The first weighting has a value of 1 or more so as to further increase the masking threshold. On the other hand, the second weighting is a weighting with respect to a band having lower energy than average energy. The second weighting has a value of 1 or less so as to further decrease the masking threshold.

Meanwhile, with respect to loudness r equally applied over the whole band, the first weighting is applied to the first band, and the second weighting is applied to the second band, to generate loudness per band (S130*a*). This may be defined as represented by the following mathematical expression.

$$r'=c\times r, \text{ for } n_i \in N$$

$$r'=d\times r, \text{ for } n_i \notin N \quad \text{[Mathematical expression 9]}$$

Where, r' indicates loudness per band, c indicates a first weighting, d indicates a second weighting, and r indicates loudness.

The first weighting may have a value of 1 or more, and the second weighting may have a value of 1 or less. That is, the loudness is further increased in the band having high energy, and the loudness is further decreased in the band having low energy. In this way, the masking threshold is adjusted so as to maintain a modification effect of the masking threshold per frequency band. Meanwhile, the first weighting and the second weighting may be equal to those generated at Step S124*a*, to which, however, the present invention is not limited.

Hereinafter, a process of generating a modified masking threshold using the weighting decided at Step S124*a* and the loudness decided at Step S130*a* will be described. First, at Step 162*a*, when the current band of an audio signal is a first band ("YES" at Step S162*a*), a first weighting is applied to a masking threshold of the first band to generate a modified masking threshold (S164*a*). For example, the first weighting may be applied as represented by the following mathematical expression.

$$\text{thr}'(n_i)=a\times\text{thr}(n_i), \text{ for } n_i \in N \quad \text{[Mathematical expression 10]}$$

Where, $\text{thr}(n_i)$ indicates a masking threshold of the current band, a indicates a first weighting, and $\text{thr}'(n_i)$ indicates a modified masking threshold of the current band.

The first weighting may have a value of 1 or more. In this case, $\text{thr}'(n_i)$ may be greater than $\text{thr}(n_i)$. Increase of the masking threshold means that even high volume signals can be masked. Therefore, a larger quantization error may be allowed. That is, since auditory sensitivity is low in a band having relatively high energy, larger quantization noise is allowed to achieve bit reduction.

On the other hand, when the current band of an audio signal is a second band ("NO" at Step S162*a*), a second weighting is applied to a masking threshold (S166*a*). The second weighting may be applied as represented by the following mathematical expression.

$$\text{thr}'(n_i)=b\times\text{thr}(n_i), \text{ for } n_i \notin N \quad \text{[Mathematical expression 11]}$$

Where, $\text{thr}(n_i)$ indicates a masking threshold of the current band, b indicates a second weighting, and $\text{thr}'(n_i)$ indicates a modified masking threshold of the current band.

The second weighting may have a value of 1 or less. In this case, $\text{thr}'(n_i)$ may be less than $\text{thr}(n_i)$. Decrease of the masking threshold means that only low volume signals can be masked. Therefore, a smaller quantization error is allowed. That is, since auditory sensitivity is high in a band having relatively low energy, little quantization noise is allowed to increase bit allocation and thus improve sound quality.

The first weighting and the second weighting are applied to the corresponding bands through Step S162*a* to Step S166*a* to generate a modified masking threshold.

Meanwhile, loudness per band generated at Step S130*a* may also be used to generate a modified masking threshold. For example, a masking threshold modified as represented by the following mathematical expression may be generated.

$$thr_r(n_i) = \min\left((thr'(n_i)^{0.25} + r')^4, \frac{en(n)}{minSnr(n)}\right) \quad \text{[Mathematical expression 12]}$$

Where, $thr_r(n_i)$ indicates a modified masking threshold, $thr'(n_i)$ indicates the result at Step S164*a* or at Step S166*a*, r' indicates loudness per band, en(n) indicates energy of the current band, and minSnr(n) indicates a minimum signal to noise ratio.

Hereinafter, an example of generating a weighting changed per band and applying the weighting to a masking threshold will be described with reference to FIG. 4. To this end, a relationship between a masking threshold, loudness, and perceived entropy will be described, and then a weighting application process will be described.

First, a relationship between a masking threshold based on a psychoacoustic model and a masking threshold to which loudness is applied is as follows.

$$T_r(n)=(T(n)^{0.25}+r)^4 \quad \text{[Mathematical expression 13]}$$

Where, T(n) indicates an initial masking threshold of an n-th frequency band based on a psychoacoustic model, $T_r(n)$ indicates a masking threshold to which loudness is applied, and r indicates loudness.

The term r included in the above mathematical expression is loudness, which is a constant added to each scale factor band. A specific value of the loudness may be calculated from total perceived entropy Pe (sum of Pe values of the respective scale factor bands). Meanwhile, the perceived entropy may be developed as represented by the following mathematical expression so as to reveal a relationship between loudness and a threshold.

$$\begin{aligned} Pe &= \sum_n pe(n) = \sum_n l_q(n)\log_2\left(\frac{E(n)}{T_r(n)}\right) \quad \text{[Mathematical expression 14]} \\ &= \sum_n l_q(n)\log_2(E(n)) - \\ &\quad \sum_n l_q(n)\log_2(T(n)^{0.25} + r) \\ &\simeq A - 4B\log_2(T_{avg}^{0.25} + r), \end{aligned}$$

Where, pe(n) indicates perceived entropy, E(n) indicates energy of an n-th scale factor band, $l_q(n)$ indicates the estimated number of lines which are not 0 after quantization, and $$A = \sum_n l_q(n)\log_2(E(n)),\ B = \sum_n l_q(n),$$

and $T_{avg}$ indicate an average approximate value of total thresholds.

When desired perceived entropy $pe_r$ at a given bit rate is substituted to Pe in the above mathematical expression, constant loudness r is expressed as represented by the following mathematical expression.

$$r=2^{(A-pe_r)/4B}-T_{avg}^{0.25} \quad \text{[Mathematical expression 15]}$$

$T_{avg}$ is an average value of initial masking thresholds. In this case, r may be assumed to be 0. When $pe_0$ is total perceived entropy acquired from the initial masking thresholds, therefore, $T_{avg}^{0.25}$ may be calculated to be $2^{(A-pe_0)/4B}$. A masking threshold is updated through Mathematical expression 13 based on a reduction value r, with the result that $pe_1$, which is perceived entropy PE, is calculated. If an absolute value of the difference between $pe_r$ and $pe_1$ is greater than a predetermined threshold, calculation of a new reduction value is repeated using $pe_r$ and the updated perceived entropy. A new reduction value is added to the previously calculated value so as to obtain a final reduction value.

Meanwhile, Mathematical expression 13 may be modified to include a weighting w(n) as represented by the following mathematical expression.

$$T_{wr}(n)=(T(n)^{0.25}+w(n)r)^4 \quad \text{[Mathematical expression 16]}$$

Where, w(n) indicates a weighting, which corresponds to energy per band. The weighting may be proportional to energy per band. Here, "proportional" means that a weighting increases as energy per band increases. However, this relationship is not necessarily directly proportional.

The weighting may be defined as a ratio of energy per band to average energy over the entire spectrum, for example, as follows.

$$w(n) = \frac{Es(n)}{\frac{1}{N}\sum_{n=1}^{N} Es(n)} \quad \text{[Mathematical expression 17]}$$

Where, N indicates the number of whole frequency bands encoded, and Es(n) indicates a value of energy of an n-th band which is diffused using an energy expansion function. Energy contour depends upon a spectral envelope, which is suitable for introducing a perceptual weighting effect.

Therefore, average energy across all bands $$\frac{1}{N}\sum_{n=1}^{N} Es(n)$$

is calculated first so as to obtain a weighting per band w(n) (S122*b*). Subsequently, energy Es(n) of the current band is calculated (S124*b*). A weighting per band w(n) is decided using the average energy calculated at Step S122*b* and the energy of the current band calculated at Step S124*b* (S126*b*).

The generated weighting w(n) is increased at a peak band but is decreased at a valley band, and therefore, it is possible to control a bit rate reflecting a perceptual weighting concept. Since the masking threshold at the peak band is greater than a value of T, a larger quantization error is allowed. On the other hand, the masking threshold is decreased as to allow a larger amount of bits at a band having lower energy than an intermediate value, i.e., at the valley band, with the result that a quantization error is reduced.

Such a weighting application concept may be more effective for a signal, such as a speech vowel, having a spectral tilt or a formant.

Meanwhile, when weighting change is too sharp, a serious auditory defect may occur. In order to prevent occurrence of such a serious auditory defect, w(n) may be restricted by a lower bound and an upper bound as represented by the following mathematical expression using the form of a sigmoid function so as to decide a modified weighting (per band) (S128*b*).

$$\tilde{w}(n) = \frac{1}{1 + e^{(1-w(n))}} + 0.5$$ [Mathematical expression 18]

Where, w(n) indicates a weighting, and $\tilde{w}(n)$ indicates a modified weighting.

Figure 5:
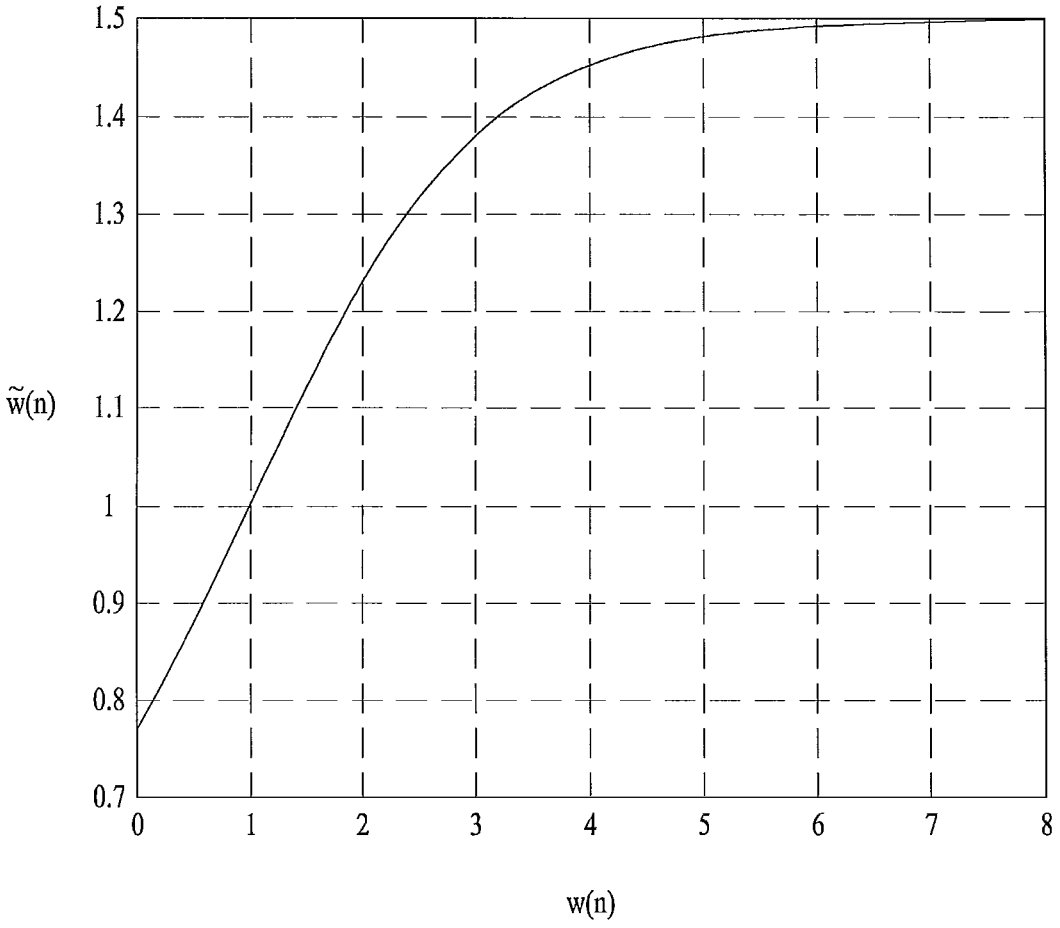
FIG. 5 is a graph illustrating a relationship between a weighting and a modified weighting.

The maximum value of $\tilde{w}(n)$ is 1.5, and the minimum value of $\tilde{w}(n)$ is 1/(1+e)+0.5 (approximately 0.77). FIG. 5 is a graph illustrating a relationship between a weighting w(n) and a modified weighting $\tilde{w}(n)$. Referring to FIG. 5, for example, when w(n) is 0, $\tilde{w}(n)$ is approximately 0.77. When w(n) is 8 or more $\tilde{w}(n)$ converges on approximately 1.5. That is, the difference between the maximum value and the minimum value of $\tilde{w}(n)$ is approximately 0.75 (1.5−0.77). Consequently, a variation width of $\tilde{w}(n)$ is less than that of w(n). Also, when the weighting w(n) varies from 4 to 8, the modified weighting $\tilde{w}(n)$ only varies from 1.45 to 1.5. That is, variation of the modified weighting $\tilde{w}(n)$ is gentle.

The modified weighting $\tilde{w}(n)$ is approximately but not directly proportional to the energy of a given band (i.e., there is no linear relationship between energy band and weighting) like the weighting of Mathematical expression 17. Meanwhile, Mathematical expression 18 may be variously modified according to a bit rate, signal properties, or usage, by which, however, the present invention is not limited.

Loudness r is decided to have a final value $\tilde{r}$ based on constraints of a bit rate (S130*b*). Hereinafter, Step S130*b* will be described in detail. When a loudness of $\tilde{w}(n)r$ is added to the above mathematical expression, the masking threshold is increased. Consequently, audible quantization noise may be considered to have a specific loudness of $\tilde{w}(n)r$ at an n-th band, i.e., $N'_{noise}(n)=\tilde{w}(n)r$. Based on constraints of a bit rate, a value of r may be decided so as to minimize total noise loudness $N'_{noise}(n)=\tilde{w}(n)r$. In Mathematical expression 16, perceived entropy due to $T_{wr}(n)$ is set to desired perceived entropy $pe_r$ according to constraints of a given bit rate. A cost function to solve this problem may be set using a Lagrange multiplier as represented by the following mathematical expression.

$$D(r, \lambda) = \sum_{n=1}^{N} (\tilde{w}(n)r)^2 + \lambda\left(\sum_{n=1}^{N} l_q(n)\log_2(T(n)^{0.25} + \tilde{w}(n)r) - C\right)$$ [Mathematical expression 19]

Where, $$C = \left(\sum_{n=1}^{N} l_q(n)\log_2(E(n)) - pe_r\right)\Big/4$$

is related to constraints of a bit rate, and $l_q(n)$ and E(n) are the same as in Mathematical expression 14.

Assuming that $0 \le (\tilde{w}(n)r)/T(n)^{0.25} \ll 1$, the second term in parenthesis of the above mathematical expression may approximate to a quadratic polynomial of a Taylor series.

$$\tilde{D}(r, \lambda) = r^2\sum_{n=1}^{N} \tilde{w}^2(n) + \lambda\left(-\frac{r^2}{2\ln 2}\sum_{n=1}^{N} \frac{l_q(n)\tilde{w}^2(n)}{T(n)^{0.5}} + \frac{r}{\ln 2}\sum_{n=1}^{N} \frac{l_q(n)\tilde{w}(n)}{T(n)^{0.25}} + \sum_{n=1}^{N} l_q(n)\log_2(T(n)^{0.25}) - C\right)$$ [Mathematical expression 20]

A constrained least square problem is solved to calculate two roots $r_1$ and $r_2$ as represented by the following mathematical expression.

$$r_1 = \max\left(\frac{c_3}{c_1\lambda_1 - c_2}, 0\right),$$ [Mathematical expression 21]

$$r_2 = \max\left(\frac{c_3}{c_1\lambda_2 - c_2}, 0\right),$$

$$(\lambda_1, \lambda_2) = \mathrm{Re}\left\{\frac{(2c_2c_4 - c_3^2) \pm c_3\sqrt{c_3^2 + 2c_1c_4}}{2c_1c_4}\right\},$$

Where, $$c_1 = \frac{1}{\ln 2}\sum_{n=1}^{N} [l_q(n)\tilde{w}^2(n)/T(n)^{0.5}],$$

$$c_2 = \sum_{n=1}^{N} 2\tilde{w}^2(n),$$

$$c_3 = \frac{1}{\ln 2}\sum_{n=1}^{N} [l_q(n)\tilde{w}(n)/T(n)^{0.25}],$$

$$c_4 = \sum_{n=1}^{N} l_q(n)\log_2(T(n)^{0.25}) - C.$$

If both $r_1$ and $r_2$ are positive numbers, a final value $\tilde{r}$ is decided to have a small valve. This is because noise loudness $N'_{noise}(n)=\tilde{w}(n)r$ generated by the small value is less than that generated by the large value. However, the small value is not always a correct root. This is because, as represented by Mathematical expression 21, r has a minimum bound of zero. For example, if $r_1$ is a negative number and $r_2$ is a positive number, $r_1$ is selected as a root although $r_2$ is a correct root if $r_1$ is set to 0. Therefore, a final value $\tilde{r}$ is decided to have a larger valve than two values.

$$\tilde{r} = \begin{cases} \min(r_1, r_2), & \text{if } r_1 > 0 \text{ and } r2 > 0 \\ \max(r_1, r_2), & \text{otherwise} \end{cases}$$ [Mathmatical expression 22]

A masking threshold for quantization is newly updated using a reduction value $\tilde{r}$ and an energy weighting $\tilde{w}(n)$. However, if the absolute difference between desired perceived entropy $pe_r$ and resultant perceived entropy is greater than a predetermined masking threshold, an additional reduction value is calculated using Mathematical expression 22 and is added to $\tilde{r}$ using a conventional method.

As described above, Step S130*b*, i.e., a process of deciding loudness r to have a final value $\tilde{r}$ based on constraints of a bit rate, has been described.

A modified masking threshold $T_{wr}(n)$ is generated using the modified weighting $\tilde{w}(n)$ decided at Step S128*b* and the loudness $\tilde{r}$ decided at Step S130*b* (S160*b*). Mathematical expression 18 and Mathematical expression 22 may be substituted into Mathematical expression 16 so as to generate a modified masking threshold.

Figure 6:
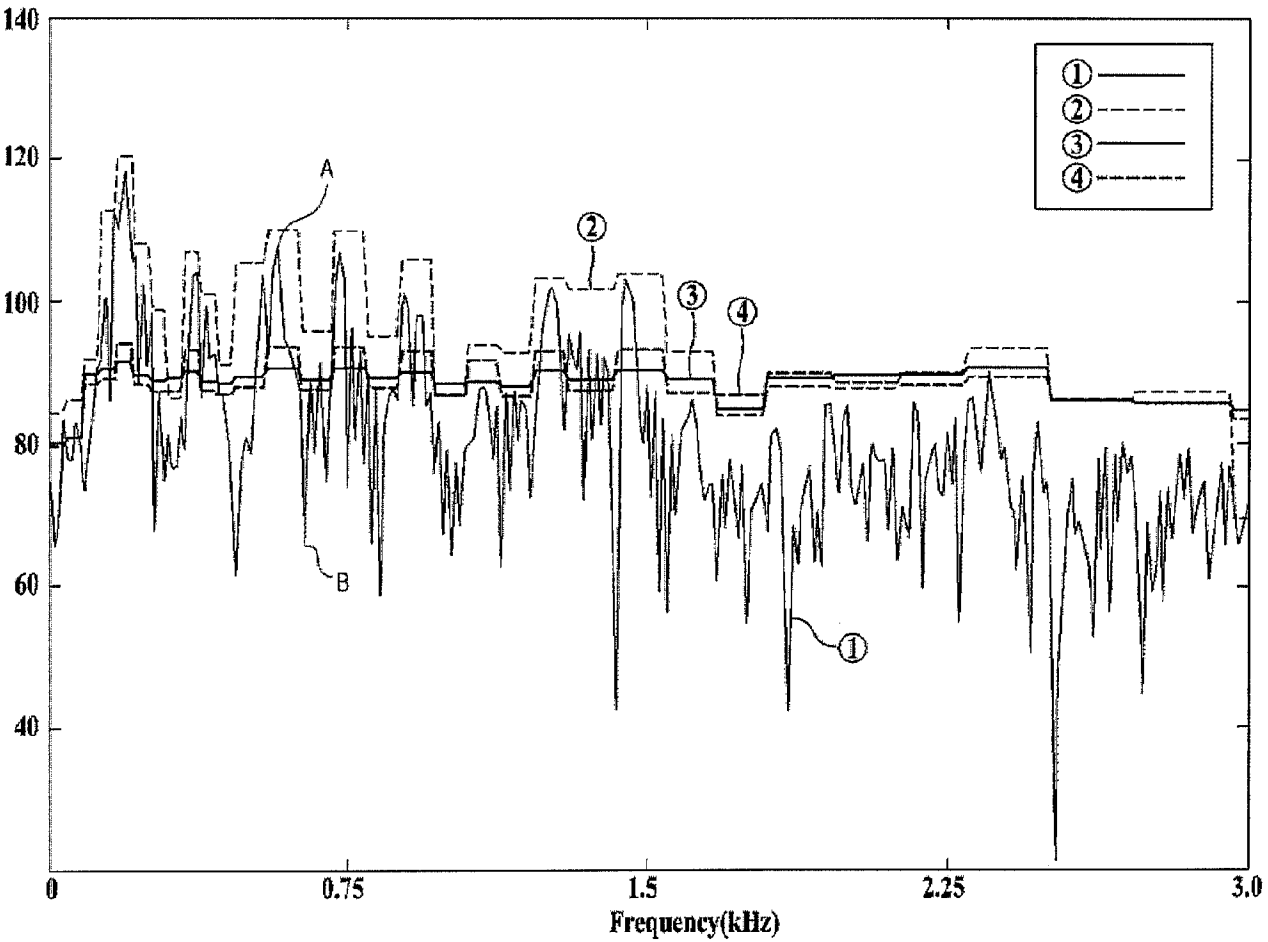
FIG. 6 is a view illustrating an example of a masking threshold generated by a spectral data encoding device according to an embodiment of the present invention.

FIG. 6 is a view illustrating an example of a masking threshold generated by a spectral data encoding device according to an embodiment of the present invention. This example may be a modified masking threshold generated at Step S160, Step 160*a*, and Step 160*b*.

In FIG. 6, the horizontal axis indicates a frequency, and the vertical axis indicates intensity (dB) of a signal. In FIG. 6, a solid line ① indicates a spectrum of an audio signal, a dotted line ② indicates an energy contour of the audio signal, a bold solid line ③ indicates a masking threshold based on a psychoacoustic model, and a bold dotted line ④ indicates a modified masking threshold according to the embodiment of the present invention. In a spectrum of an audio spectrum, a region having a relatively large intensity (for example, a region A of FIG. 6) may be referred to as a peak, and a region having a relatively low intensity (for example, a region B of FIG. 6) may be referred to as a valley. Meanwhile, when an audio signal contains speech, a region having a peak may be a formant frequency band or a harmonic frequency band, to which, however, the present invention is not limited. Here, the formant frequency band may result from linear prediction coding (LPC).

According to the present invention, a band having a relatively high intensity of energy may have a weighting of 1 or more, and a band having a relatively low intensity of energy may have a weighting of 1 or less. Therefore, a weighting of 1 or more is applied to the masking threshold ③ based on the psychoacoustic model in a band, such as the region A of FIG. 6, with the result that the modified masking threshold ④ according to the present invention is greater than the masking threshold ③. On the other hand, a weighting of 1 or less is applied to the masking threshold ③ based on the psychoacoustic model in a band, such as the region B of FIG. 6, with the result that the modified masking threshold ④ according to the present invention is less than the masking threshold ③.

Figure 7:
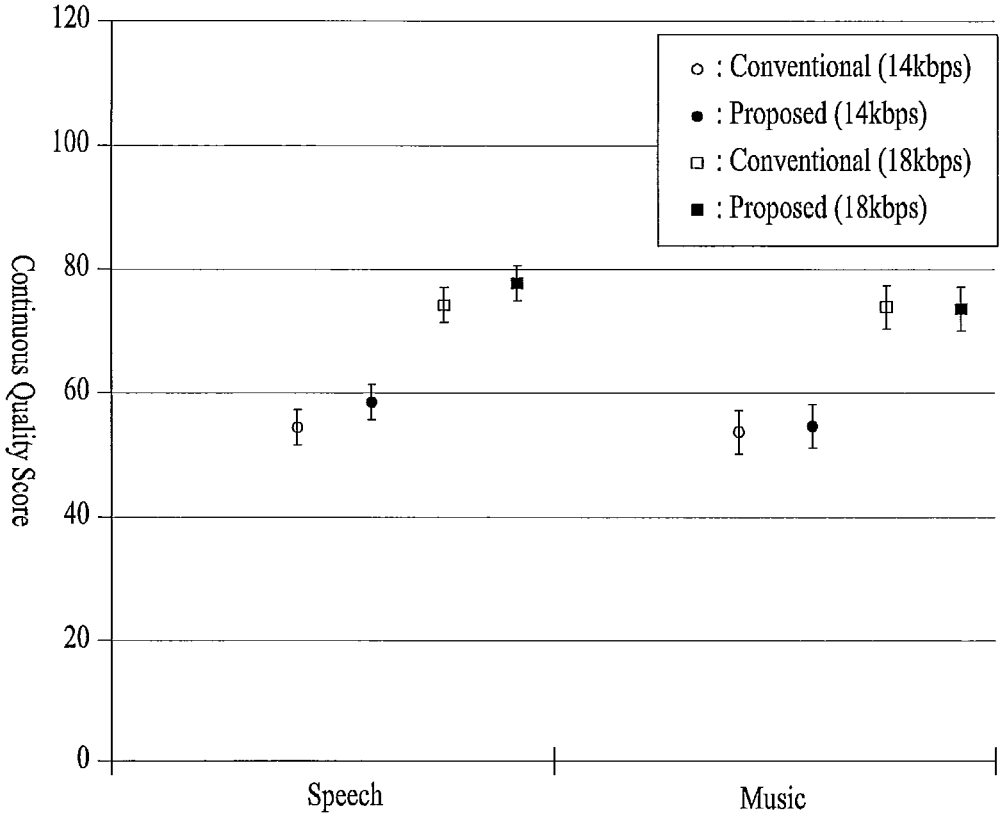
FIG. 7 is a graph illustrating comparison between performance of the present invention and performance of the conventional art.

FIG. 7 is a graph illustrating comparison between performance of the present invention and performance of the conventional art. In FIG. 7, circular figures ○ and ● indicate a bit rate of 14 kbps, and square figures □ and ■ indicate a bit rate of 18 kbps. Meanwhile, white figures ○ and □ indicate conventional qualities, and black figures ● and ■ indicate proposed qualities. Experiments were carried out with respect to a speech signal and a music signal. When a modified masking threshold was applied with respect to all objects under the same bit rate conditions, the proposed qualities ● and ■ were excellent.

Figure 8:
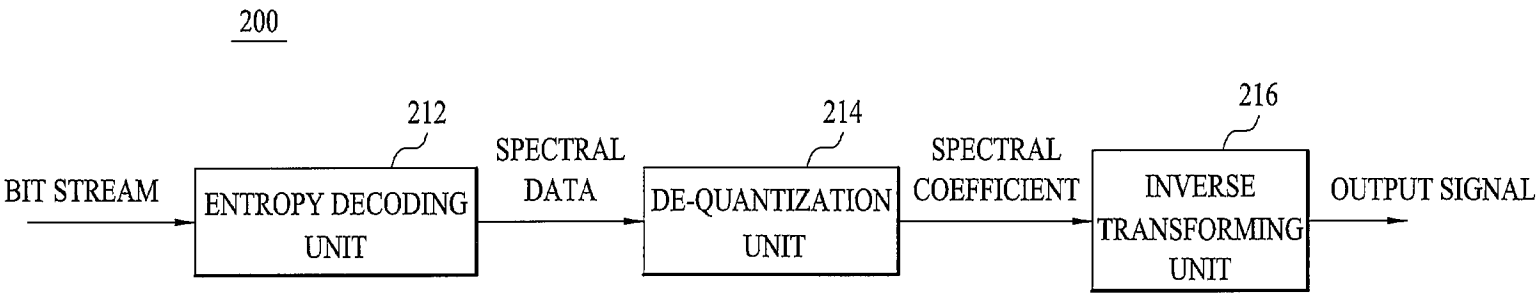
FIG. 8 is a construction view illustrating a spectral data decoding device of the apparatus for processing an audio signal according to the embodiment of the present invention.

FIG. 8 is a construction view illustrating a spectral data decoding device of the apparatus for processing an audio signal according to the embodiment of the present invention. Referring to FIG. 8, a spectral data decoding device 200 includes an entropy decoding unit 212, a de-quantization unit 214, and an inverse transforming unit 216. The spectral data decoding device 200 may further include a demultiplexing unit (not shown).

The demultiplexing unit (not shown) receives a bit stream and extracts spectral data and a scale factor from the received bit stream. The spectral data are generated from the spectral coefficient through quantization. In quantizing the spectral data, quantization noise is allocated in consideration of a masking threshold. Here, the masking threshold is not a masking threshold generated using a psychoacoustic model but a modified masking threshold generated by applying a weighting to the masking threshold generated by the psychoacoustic model. The modified masking threshold is provided to allocate larger quantization noise in a peak band and smaller quantization noise in a valley band.

The entropy decoding unit 212 entropy decodes spectral data. The entropy coding may be performed based on a Huffman coding scheme, to which, however, the present invention is not limited.

The de-quantization unit 214 de-quantizes spectral data and a scale factor to generate a spectral coefficient.

The inverse transforming unit 216 performs frequency to time mapping to generate an output signal using the spectral coefficient. Here, the frequency to time mapping may be performed based on inverse quadrature mirror filterbank (IQMF) or inverse modified discrete Fourier transform (IMDCT), to which, however, the present invention is not limited.

Figure 9:
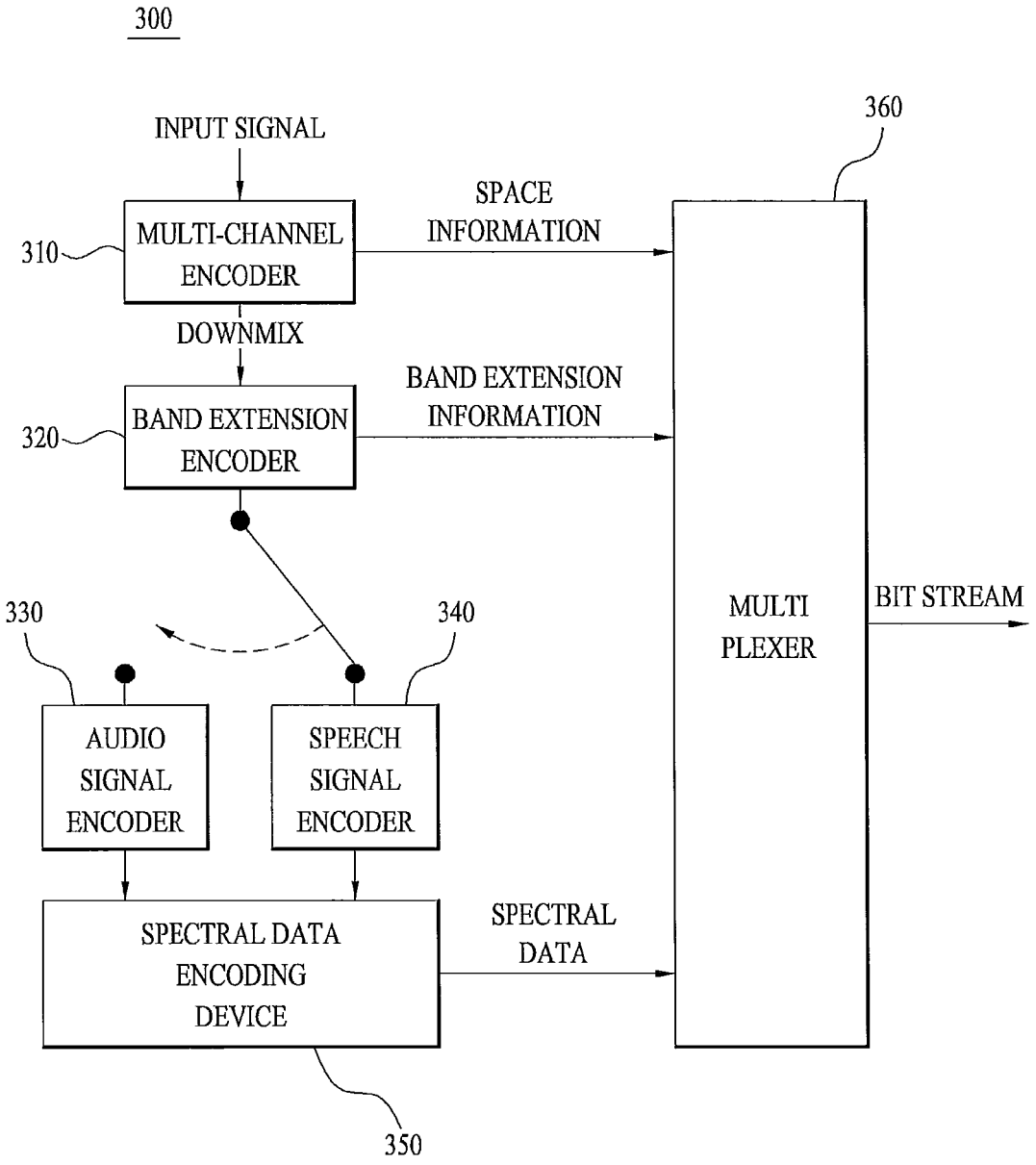
FIG. 9 is a construction view illustrating a first example (an encoding device) of the apparatus for processing an audio signal according to the embodiment of the present invention.

FIG. 9 is a construction view illustrating a first example (an encoding device) of the apparatus for processing an audio signal according to the embodiment of the present invention. Referring to FIG. 9, an audio signal encoding device 300 includes a multi-channel encoder 310, a band extension encoder 320, an audio signal encoder 330, a speech signal encoder 340, and a multiplexer 360. Of course, the audio signal encoding device 300 may further include a spectral data encoding device 350 according to an embodiment of the present invention.

The multi-channel encoder 310 receives a plurality of channel signals (two or more channel signals) (hereinafter, referred to as a multi-channel signal), performs downmixing to generated a mono downmixed signal or a stereo downmixed signal, and generates space information necessary to upmix the downmixed signal into a multi-channel signal. Here, space information may include channel level difference information, inter-channel correlation information, a channel prediction coefficient, downmix gain information, and the like. If the audio signal encoding device 300 receives a mono signal, the multi-channel encoder 310 may bypass the mono signal without downmixing the mono signal.

The band extension encoder 320 may generate band extension information to restore data of a downmixed signal excluding spectral data of a partial band (for example, a high frequency band) of the downmixed signal.

The audio signal encoder 330 encodes a downmixed signal using an audio coding scheme when a specific frame or segment of the downmixed signal has a high audio property. Here, the audio coding scheme may be based on an advanced audio coding (ACC) standard or a high efficiency advanced audio coding (HE-ACC) standard, to which, however, the present invention is not limited. Meanwhile, the audio signal encoder 330 may be a modified discrete transform (MDCT) encoder.

The speech signal encoder 340 encodes a downmixed signal using a speech coding scheme when a specific frame or segment of the downmixed signal has a high speech property. Here, the speech coding scheme may be based on an adaptive multi-rate wide band (AMR-WB) standard, to which, however, the present invention is not limited. Meanwhile, the speech signal encoder 340 may also use a linear prediction coding (LPC) scheme. When a harmonic signal has high redundancy on the time axis, the harmonic signal may be modeled through linear prediction which predicts a current signal from a previous signal. In this case, the LPC scheme may be adopted to improve coding efficiency. Meanwhile, the speech signal encoder 340 may be a time domain encoder.

The spectral data encoding device 350 performs frequency-transforming, quantization, and entropy encoding with respect to an input signal so as to generate spectral data. The spectral data encoding device 350 includes at least some (in particular, the weighting decision unit 122 and the masking threshold generation unit 124) of the components of the spectral data encoding device according to the embodiment of the present invention previously described with reference to FIG. 1, and therefore, a detailed description thereof will not be given.

The multiplexer 360 multiplexes space information, band extension information, and spectral data to generate an audio signal bit stream.

Figure 10:
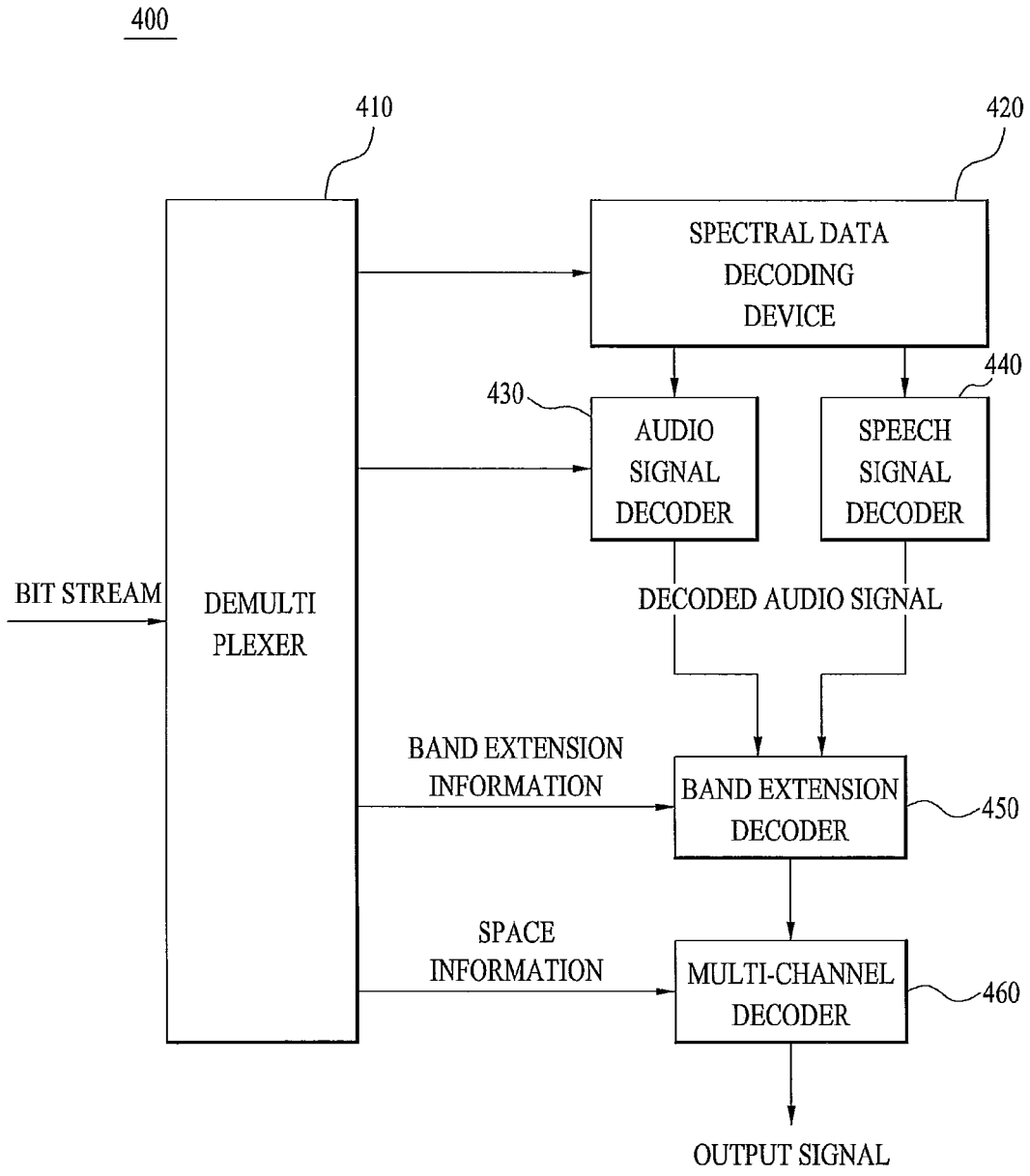
FIG. 10 is a construction view illustrating a second example (a decoding device) of the apparatus for processing an audio signal according to the embodiment of the present invention.

FIG. 10 is a construction view illustrating a second example (a decoding device) of the apparatus for processing an audio signal according to the embodiment of the present invention. Referring to FIG. 10, an audio signal decoding device 400 includes a demultiplexer 410, an audio signal decoder 430, a speech signal decoder 440, a band extension decoder 450, and a multi-channel decoder 460. Also, the audio signal decoding device 400 further includes a spectral data decoding device 420 according to an embodiment of the present invention is further included.

The demultiplexer 410 multiplexes spectral data, band extension information, and space information from an audio signal bit stream.

The spectral data decoding device 420 performs entropy encoding and de-quantization using spectral data and a scale factor. The spectral data decoding device 420 may include at least the de-quantization unit 214 of the spectral data decoding device 200 previously described with reference to FIG. 8.

The audio signal decoder 430 decodes spectral data corresponding to a downmixed signal using an audio coding scheme when the spectral data has a high audio property. Here, the audio coding scheme may be based on an ACC standard or an HE-ACC standard, as previously described. The speech signal decoder 440 decodes a downmixed signal using a speech coding scheme when the spectral data has a high speech property. Here, the speech coding scheme may be based on an AMR-WB standard, as previously described, to which, however, the present invention is not limited.

The band extension decoder 450 decodes a bit stream of band extension information and generates spectral data of a different band (for example, a high frequency band) from some or all of the spectral data using this information.

When the decoded audio signal is downmixed, the multi-channel decoder 460 generates an output channel signal of a multi-channel signal (including a stereo channel signal) using space information.

The spectral data encoding device or the spectral data decoding device according to the present invention may be included in a variety of products, which may be divided into a standalone group and a portable group. The standalone group may include televisions (TV), monitors, and settop boxes, and the portable group may include portable media players (PMP), mobile phones, and navigation devices.

Figure 11:
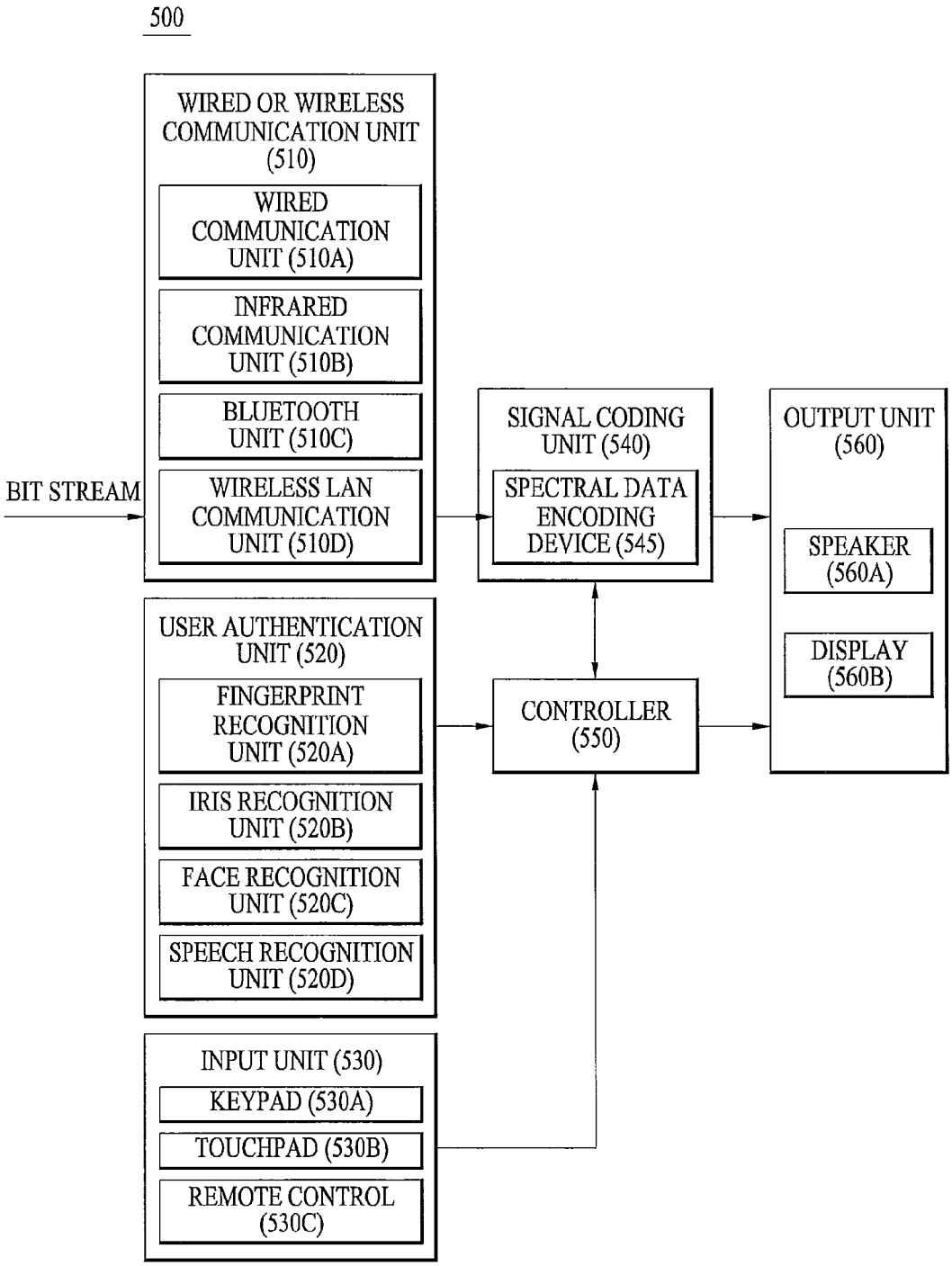
FIG. 11 is a schematic construction view illustrating a product to which the spectral data encoding device according to the embodiment of the present invention is applied.
Figure 12:
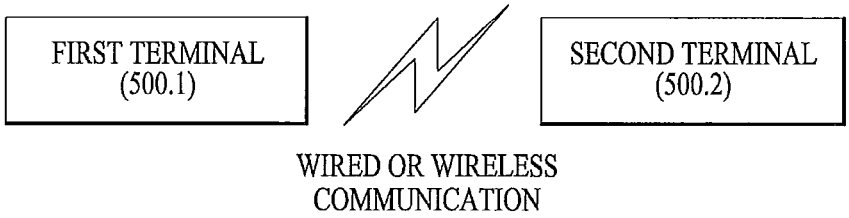
FIG. 12 is a view illustrating a relationship between products to which the spectral data encoding device according to the embodiment of the present invention is applied.
Figure 12:
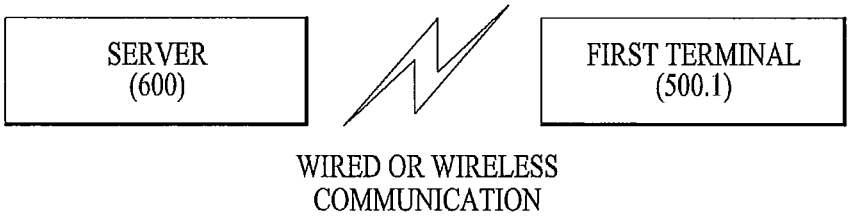

FIG. 11 is a schematic construction view illustrating a product to which the spectral data encoding device or the spectral data decoding device according to the embodiment of the present invention is applied. FIG. 12 is a view illustrating a relationship between products to which the spectral data encoding device or the spectral data decoding device according to the embodiment of the present invention is applied.

Referring first to FIG. 11, a wired or wireless communication unit 510 receives a bit stream using a wired or wireless communication scheme. Specifically, the wired or wireless communication unit 510 may include at least one selected from a group consisting of a wired communication unit 510A, an infrared communication unit 510B, a Bluetooth unit 510C, and a wireless LAN communication unit 510D.

A user authentication unit 520 receives user information to authenticate a user. The user authentication unit 520 may include at least one selected from a group consisting of a fingerprint recognition unit 520A, an iris recognition unit 520B, a face recognition unit 520C, and a speech recognition unit 520D. The fingerprint recognition unit 520A, the iris recognition unit 520B, the face recognition unit 520C, and the speech recognition unit 520D receive fingerprint information, iris information, face profile information, and speech information, respectively, convert the received information into user information, and determine whether the user information coincides with registered user data to authenticate the user.

An input unit 530 allows a user to input various kinds of commands. The input unit 530 may include at least one selected from a group consisting of a keypad 530A, a touchpad 530B, and a remote control 530C, to which, however, the present invention is not limited. A signal coding unit 540 includes a spectral data encoding device 545 or a spectral data decoding device. The spectral data encoding device 545 includes at least the weighting decision unit and the masking threshold generation unit of the spectral data encoding device previously described with reference to FIG. 1. The spectral data encoding device 545 applies a weighting to a masking threshold so as to generate a modified masking threshold. On the other hand, the spectral data decoding device (not shown) includes at least the de-quantization unit of the spectral data decoding device previously described with reference to FIG. 8. The spectral data decoding device generates a spectral coefficient using spectral data generated based on a modified masking threshold. A signal coding unit 540 encodes an input signal through quantization to generate a bit stream or decodes the signal using the received bit stream and spectral data to generate an output signal.

A controller 550 receives input signals from input devices and controls all processes of the signal coding unit 540 and an output unit 560. The output unit 560 outputs an output signal generated by the signal coding unit 540. The output unit 560 may include a speaker 560A and a display 560B. When an output signal is an audio signal, the output signal is output to the speaker. When an output signal is a video signal, the output signal is output to the display.

FIG. 12 shows a relationship between terminals each corresponding to the product shown in FIG. 11 and between a server and a terminal corresponding to the product shown in FIG. 11. Referring to FIG. 12(A), a first terminal 500.1 and a second terminal 500.2 bidirectionally communicate data or a bit stream through the respective wired or wireless communication units thereof. Referring to FIG. 12(B), a server 600 and a first terminal 500.1 may communicate with each other in a wired or wireless communication manner.

The method for processing an audio signal according to the present invention may be modified as a program which can be executed by a computer. The program may be stored in a recording medium which can be read by the computer. Also, multimedia data having a data structure according to the present invention may be stored in a recording medium which can be read by the computer. The recording medium which can be read by the computer includes all kinds of devices that store data which can be read by the computer. Examples of the recoding medium which can be read by the computer may include a read only memory (ROM), a random access memory (RAM), a compact disc ROM (CD-ROM), a magnetic tape, a floppy disc, and an optical data storage device. In addition, a recoding medium employing a carrier waver (for example, transmission over the Internet) format may be further included. Also, a bit stream generated by the encoding method as described above may be stored in a recording medium which can be read by a computer or a transmitted using a wired or wireless communication network.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The present invention is applicable to encoding and decoding of an audio signal.

What is claimed is:

1. A method for processing an audio signal by an encoding device, the method comprising:

frequency-transforming, by a frequency-transforming unit of the encoding device, an audio signal to generate a frequency spectrum;

deciding, by a weighting decision unit of the encoding device, a weighting per band corresponding to energy per band using the frequency spectrum;

receiving, by a masking threshold generation unit of the encoding device, a masking threshold based on a psychoacoustic model;

applying, by a masking threshold generation unit of the encoding device, the weighting to the masking threshold to generate a modified masking threshold;

quantizing, by a quantization unit of the encoding device, the audio signal using the modified masking threshold; and deciding a speech property with respect to the audio signal, wherein the step of deciding the weighting per band and the step of generating the modified masking threshold are carried out in a band having the speech property of a whole band of the audio signal.

2. The method of claim 1, wherein the weighting per band is generated based on a ratio of energy of a current band to average energy of a whole band.

3. The method of claim 1, further comprising:

calculating loudness based on constraints of a given bit rate using the frequency spectrum, wherein the modified masking threshold is generated based on the loudness.

4. A method for processing an audio signal by an encoding device, the method comprising:

frequency-transforming, by a frequency-transforming unit of the encoding device, an audio signal to generate a frequency spectrum;

dividing, by a weighting decision unit of the encoding device, a whole band of the audio signal into a first band and a second band based on the frequency spectrum, wherein the first band has higher energy than average energy of the whole band, and the second band has lower energy than average energy of the whole band;

deciding, by a weighting decision unit of the encoding device, a first weighting corresponding to the first band and a second weighting corresponding to the second band based on the frequency spectrum;

receiving, by a masking threshold generation unit of the encoding device, a masking threshold based on a psychoacoustic model;

applying, by a masking threshold generation unit of the encoding device, the first weighting and the second weighting to the masking threshold of the corresponding first band and second band, to generate a modified masking threshold; and quantizing, by a quantization unit of the encoding device, the audio signal using the modified masking threshold.

5. The method of claim 4, wherein the first weighting has a value of 1 or more, and the second weighting has a value of 1 or less.

6. The method of claim 4, wherein:

the modified masking threshold is generated based on loudness per band, and the first weighting is applied to the first band and the second weighting is applied to the second back to generate the loudness per band.

7. An apparatus for processing an audio signal, the apparatus comprising:

an encoding device for encoding the audio signal to generate encoded data, the encoding device including:

a frequency-transforming unit for frequency-transforming an audio signal to generate a frequency spectrum, a weighting decision unit for deciding a weighting per band corresponding to energy per band using the frequency spectrum, a masking threshold generation unit for receiving a masking threshold based on a psychoacoustic model and applying the weighting to the masking threshold to generate a modified masking threshold, wherein the masking threshold generation unit analyzes speech properties of the audio signal, and when a current band corresponds to a speech signal region, the masking threshold generation unit generates the modified masking threshold, and a quantization unit for quantizing the audio signal using the modified masking threshold; and a multiplexer for multiplexing the encoded date to generate an audio signal bit stream.

8. The apparatus of claim 7, wherein the weighting per band is generated based on a ratio of energy of a current band to average energy of a whole band.

9. The apparatus of claim 7, wherein the masking threshold generation unit calculates loudness based on constraints of a given bit rate using the frequency spectrum, and the modified masking threshold is generated based on the loudness.

10. An apparatus for processing an audio signal, the apparatus comprising:

an encoding device for encoding the audio signal to generate encoded data, the encoding device including:

a frequency-transforming unit for frequency-transforming an audio signal to generate a frequency spectrum, a weighting decision unit for dividing a whole band of the audio signal into a first band and a second band based on the frequency spectrum, wherein the first band has higher energy than average energy of the whole band, and the second band has lower energy than average energy of the whole band, and deciding a first weighting corresponding to the first band and the second weighting corresponding to a second band based on the frequency spectrum, a masking threshold generation unit for receiving a masking threshold based on a psychoacoustic model and applying the first weighting and the second weighting to the masking threshold of the corresponding first band and second band, to generate a modified masking threshold, and a quantization unit for quantizing the audio signal using the modified masking threshold, and a multiplexer for multiplexing the encoded data to generate an audio signal bit stream.

11. The apparatus of claim 10, wherein the first weighting has a value of 1 or more, and the second weighting has a value of 1 or less.

12. The apparatus of claim 10, wherein the modified masking threshold is generated based on loudness per band, and the first weighting is applied to the first band and the second weighting is applied to the second band to generate the loudness per band.

13. A method for processing an audio signal by a decoding device, the method comprising:

receiving, by the decoding device, spectral data and a scale factor with respect to an audio signal from an encoding device; and restoring, by the decoding device, the audio signal using the spectral data and the scale factor, wherein, within the encoding device, a whole band of the audio signal is divided into a first band and a second band based on a frequency spectrum, and the first band has higher energy than average energy of the whole band, and the second band has lower energy than average energy of the whole band, the spectral data and the scale factor are generated by applying a modified masking threshold to the audio signal, and the modified masking threshold is generated by applying a first weighting and a second weighting to a masking threshold of the corresponding first band and second band.

14. A non-transitory storage medium storing digital audio data and a computer program, the computer program being executed by a computer to implement the method of claim 1, the non-transitory storage medium being configured to be read by the computer, the digital including spectral data and a scale factor, the non-transitory medium comprising:

a whole band of an audio signal divided into a first band and a second band based on a frequency spectrum, the first band having higher energy than average energy of the whole band, and the second band having lower energy than average energy of the whole band, wherein the spectral data and the scale factor are generated by applying a modified masking threshold to an audio signal, and wherein the modified masking threshold is generated by applying a first weighting and a second weighting to a masking threshold of the corresponding first band and second band.

* * * * *